US006478380B2

(12) United States Patent
Ehrlich

(10) Patent No.: US 6,478,380 B2
(45) Date of Patent: Nov. 12, 2002

(54) PORTABLE LEG AND FOOT REST

(76) Inventor: Justin Ehrlich, 24 Club Ct., Pleasantville, NY (US) 10570

( * ) Notice: Subject to any disclaimer, the term of this patent is extended or adjusted under 35 U.S.C. 154(b) by 8 days.

(21) Appl. No.: 09/821,252

(22) Filed: Mar. 29, 2001

(65) Prior Publication Data

US 2002/0140272 A1 Oct. 3, 2002

(51) Int. Cl.[7] ..... A47C 7/50

(52) U.S. Cl. ..... 297/423.46; 297/423.41; 297/452.41; 5/644; 5/648

(58) Field of Search ..... 297/423.39, 423.41, 297/423.46, 452.41, 423.44; 5/644, 648, 650, 651

(56) References Cited

U.S. PATENT DOCUMENTS

| | | | | | |
|---|---|---|---|---|---|
| 3,308,489 | A | | 3/1967 | Winkler | |
| 3,680,917 | A | * | 8/1972 | Harris | 297/452.41 |
| D278,004 | S | | 3/1985 | Sigona | |
| D285,752 | S | | 9/1986 | Sadow | |
| 4,639,960 | A | * | 2/1987 | Quillen et al. | 297/452.41 |
| 5,302,003 | A | | 4/1994 | Xenofos | |
| 5,328,445 | A | | 7/1994 | Spahn | |
| D359,189 | S | | 6/1995 | Righini | |
| 5,432,967 | A | * | 7/1995 | Raftery | 5/644 |
| D360,796 | S | * | 8/1995 | Goldado | 5/651 |

* cited by examiner

*Primary Examiner*—Peter R. Brown
(74) *Attorney, Agent, or Firm*—Law Office of Leo Zucker

(57) ABSTRACT

A portable leg and foot rest has an inflatable main body portion of flexible sheet material which, when inflated, forms (a) a major rest surface, (b) a bottom surface, (c) a pair of side walls that extend between the rest surface and the bottom surface, and (d) a rear wall that extends between the rest surface and the bottom surface. A first portion of the rest surface slopes downward from the rear wall to define a first surface for supporting a person's calves and heels, and a second portion of the rest surface contiguous to the first portion, rises upward from the first portion to define a second surface for supporting soles of the person's feet.

8 Claims, 3 Drawing Sheets

PORTABLE LEG AND FOOT REST

BACKGROUND OF THE INVENTION

1. Field of the Invention

The present invention relates to leg and foot rests or cushions.

2. Discussion of the Known Art

Persons who must remain seated for many hours because of their occupation or mode of transportation, usually need to rest their feet on a comfortable supporting surface. In particular, most commercial airline passengers typically are not provided any comfortable support for their lower legs and feet due to the seating configuration and the narrow space encountered between seat rows. Even where a foot rest structure is provided in certain limited seating, such structure may not extend far enough to accommodate a full extension of a tall person's legs.

U.S. Pat. No. 5,302,003 (Apr. 12, 1994) discloses a collapsible footrest for supporting and massaging the soles of an aircraft passenger's feet. The footrest includes an inflatable chamber made of a flexible material, and a foldable frame placed internally of the chamber for added strength.

U.S. Pat. No. 5,328,445 describes an inflatable foot cushion for reducing force amplifications upon the foot when a person's body is in a supine position. See also U.S. Pat. No. 3,308,489 which discloses a cushion for resting a person's legs high.

There remains a need for a foot and leg rest that addresses the needs of airline travelers and others who require comfortable as well as therapeutic support for their feet and lower legs, regardless of their height. There is also a need for a portable foot and leg rest that can be carried conveniently by a person such as by folding and stowing in a carry-on bag, requires no assembly, and, when deployed, provides comfortable lower leg support even in limited space environments such as between rows of airline passenger seats.

SUMMARY OF THE INVENTION

According to the invention, a portable leg and foot rest includes a main body portion of flexible sheet material constructed and arranged to form, when inflated, (a) a major rest surface, (b) a bottom surface, (c) a pair of side walls that extend between the rest surface and the bottom surface, and (d) a rear wall that extends between the rest surface and the bottom surface. A first portion of the rest surface slopes downward from the rear wall to define a first surface for supporting a person's calves and heels. A second portion of the rest surface contiguous to the first portion, rises upward from the first portion to define a second surface for supporting soles of the person's feet.

An adjustment mechanism is joined to the bottom surface of the main body portion near the rear wall. The adjustment mechanism is constructed and arranged to set an angle of inclination of the major rest surface with respect to a floor on which the foot rest is placed.

For a better understanding of the invention, reference is made to the following description taken in conjunction with the accompanying drawing and the appended claims.

DETAILED DESCRIPTION OF THE INVENTION

Figure 1:
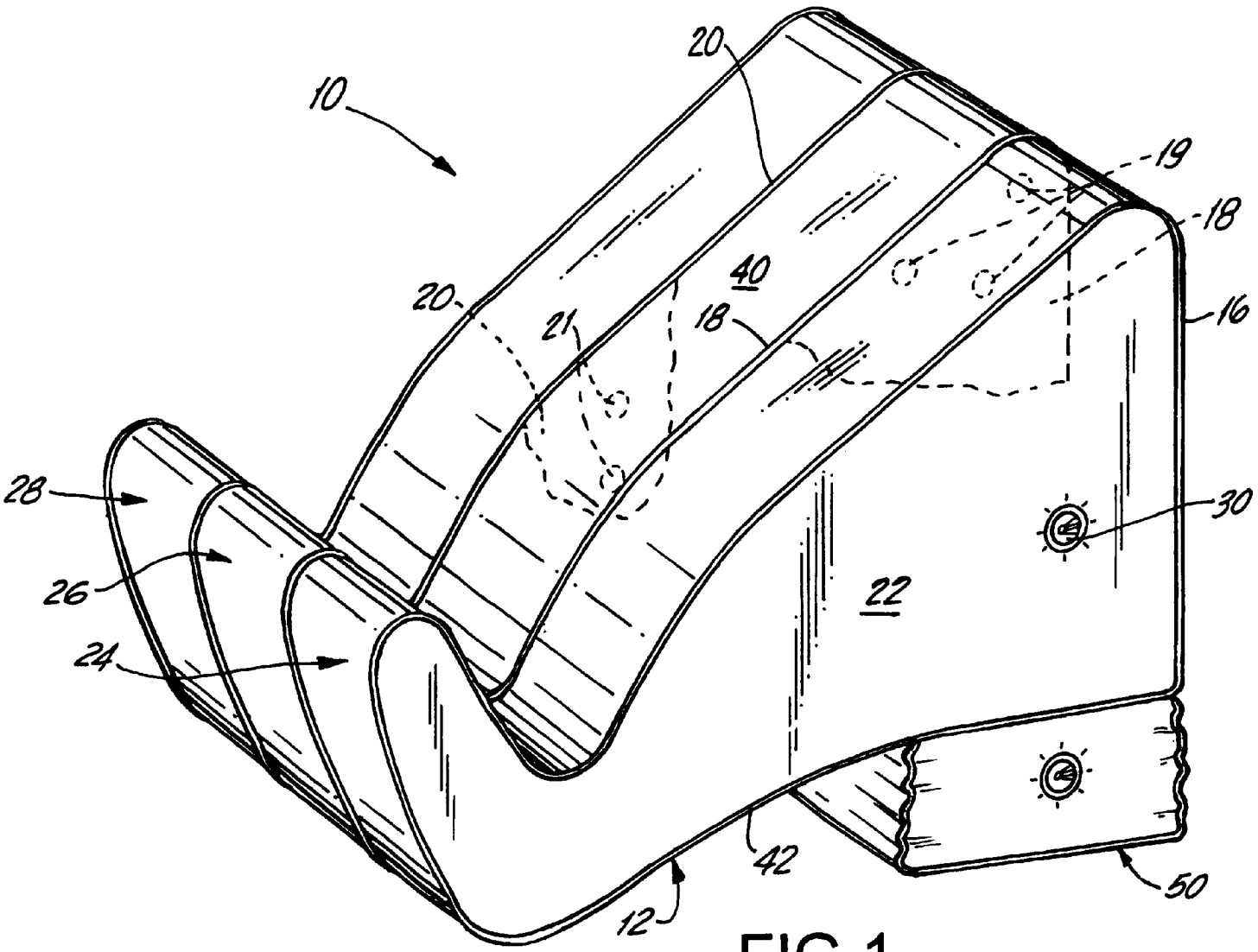
FIG. 1 is an overall view of a portable footrest according to the invention.

FIG. 1 is a perspective view of a portable leg and foot rest 10, according to the invention. The leg/foot rest 10 includes a main body portion 12. The body portion 12 is made, for example, from vinyl or a similar sheet material that can be sealed and inflated either orally or mechanically by way of a conventional air valve 14 that is mounted through a rear wall 16 (see FIG. 3) of the main body portion 12.

In the disclosed embodiment, the main body portion 12 has two interior vertical walls 18, 20 the perimeters of which correspond to perimeters of side walls 22 of the body portion 12. Vertical wall 18 has one or more perforations 19, and vertical wall 20 has one or more perforations 21. The-interior walls 18, 20, thus define three contiguous chambers 24, 26 and 28 having substantially identical outer peripheries. When the body portion 12 is inflated via the air valve 14, pressurized air is communicated into the center chamber 26, through the perforations in the walls 18, 20, and into the adjoining chambers 24, 28.

Although two interior walls are shown in the disclosed embodiment, it will be understood by those skilled in the art that fewer or more internal walls or equivalent structure may be provided within the main body portion 12. A "quick release" air cap 30 may also be provided on the side wall 22, as shown in FIGS. 1 and 2, to permit rapid deflation of the entire body portion 12 when the user wishes to fold the leg/foot rest 10 and stow it conveniently in a carry-on bag or suitcase.

The perimeters of the side walls 22 and the interior walls 18, 20, are determined so that when inflated the body portion 12 forms (a) a major rest surface 40, (b) the pair of side walls 22 one of which is visible in the drawing, (c) the rear wall 16, and (d) a bottom surface 42. A first portion of the rest surface 40 slopes downward from the rear wall 16, to define a first surface 44 for supporting a person's calves and heels. See FIGS. 2 and 3. A second portion of the rest surface 40 contiguous to the first portion, rises upward from the first portion to define a second surface 46 for supporting the soles of the person's feet. The major rest surface 40 may be constructed as a velour (e.g., flocked vinyl), or be coated with a velour or similar fabric for additional comfort.

A height or tilt adjustment chamber 50 is joined to the bottom surface 42 of the main body portion 12, to align flush with the rear wall 16. The adjustment chamber 50 is also made of a flexible vinyl or similar sheet material that can be cemented or otherwise adhered to the main body portion 12, and which can be readily inflated via an associated air valve 52. In the disclosed embodiment, the adjustment chamber 50 omits interior structure such as the vertical walls 18, 20 in the main body portion 12. Such structure may be provided within the chamber 50, if necessary, to provide added strength and rigidity when the leg/foot rest 10 is in use.

Figure 2:
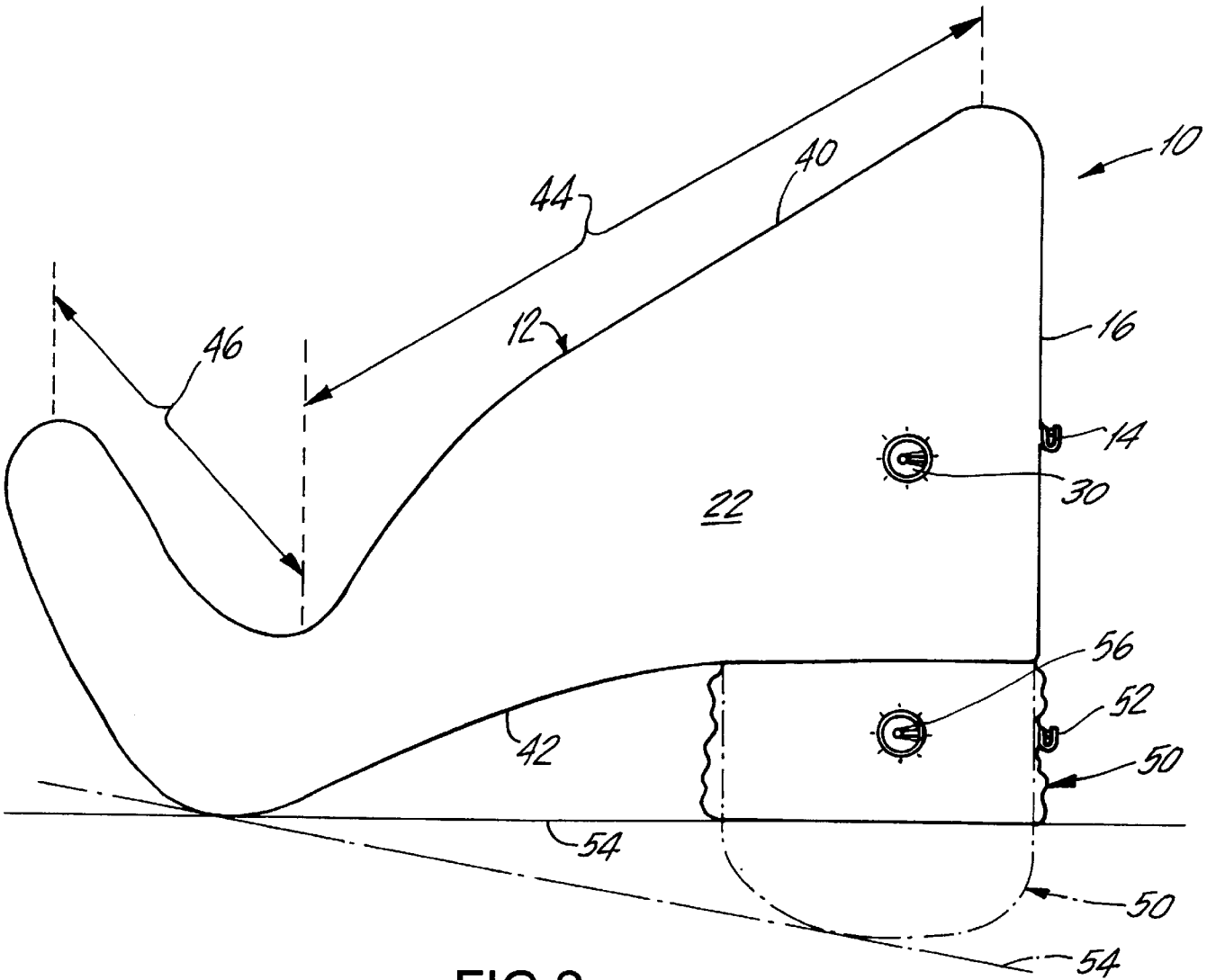
FIG. 2 is a side view of the footrest in FIG. 1, illustrating a height or tilt adjustment feature of the footrest.

As illustrated in FIG. 2, the inclination of the major rest surface 40 with respect to a ground or floor surface 54, can be adjusted by varying the degree of inflation of the adjustment chamber 50. A quick-release air cap 56 may also be provided on a side wall of the adjustment chamber 50, to allow rapid deflation when the user decides to fold the leg/foot rest 10 for transport or storage.

Figure 3:
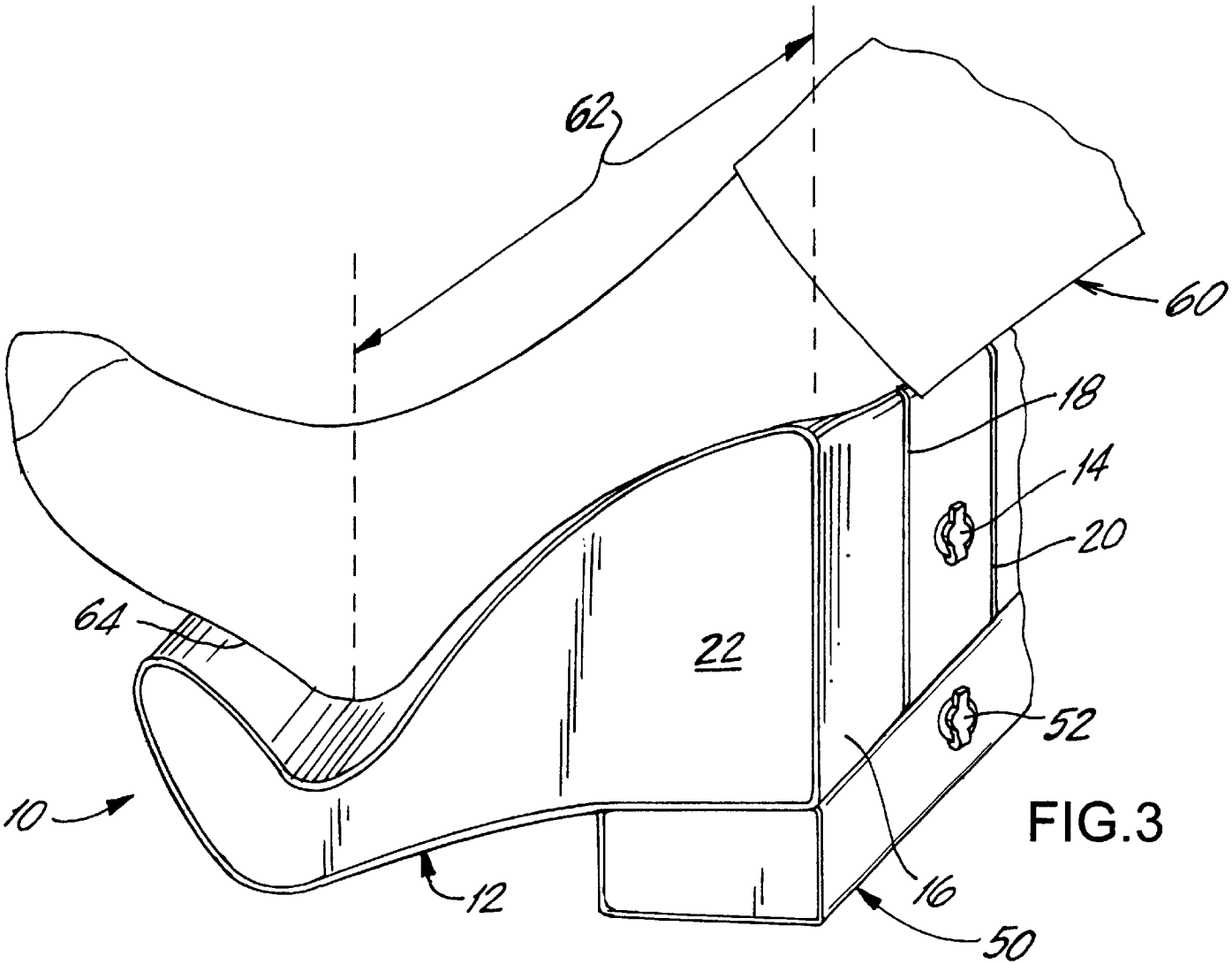
FIG. 3 is a perspective view of the footrest while supporting a person's calves and feet.

FIG. 3 shows the leg/foot rest 10 in use. A person's legs 60 are supported so that the calves and heels 62 of each leg are supported by the first surface 44 (FIG. 2) along the major rest surface 40 of the body portion 12, and soles 64 of the person's feet are supported by the second surface 46 of the major rest surface 40.

When inflated, the main body portion 12 preferably occupies less then a maximum space specified by commercial airlines for under seat storage. Typical overall dimensions for the body portion 12 when inflated are about 13 inches long, and about seven inches height along the rear wall 16. The height of the adjustment chamber 50 may vary, depending on inflation, from substantially zero to about three and one-half inches when fully inflated.

As viewed in FIG. 2 with the adjustment chamber 50 inflated to about half its maximum height, the first surface 44 slopes downward at an angle of about 35 degrees with respect to the horizontal, and the second surface 46 rises upward at an angle of about 55 degrees with respect to the horizontal. As mentioned, the width of the main body portion 12 and the adjustment chamber 50 should be set to allow at least a forward portion of the leg/foot rest 10 to slide between the rear leg supports of typical airline passenger seats.

While the foregoing description represents a preferred embodiment of the invention, it will be obvious to those skilled in the art that various changes and modifications may be made, without departing from the spirit and scope of the invention as pointed out by the following claims. For example, in addition to, or in place of the interior walls 18, 20, other structure (e.g., strips of netting and/or walls that are not parallel to the side walls 22) may be provided to define the overall shape of the main body portion 12 when the body portion is inflated.

I claim:

1. A portable leg and foot rest, comprising:

a main body portion of flexible sheet material that is constructed and arranged for inflation to form;

(a) a major rest surface, (b) a bottom surface, (c) a pair of side walls that extend between the rest surface and the bottom surface, and (d) a rear wall that extends between the rest surface and the bottom surface, wherein;

a first portion of the rest surface slopes downward from the rear wall to define a first surface for supporting a person's calves and heels; and a second portion of the rest surface contiguous to the first portion, rises upward from the first portion to define a second surface for supporting soles of the person's feet; and adjustment means joined to the bottom surface of the main body portion in the vicinity of the rear wall, wherein the adjustment means is constructed and arranged to set an angle of inclination of the major rest surface with respect to a floor on which the leg and foot rest is placed.

2. A leg and foot rest according to claim 1, wherein the adjustment means comprises an inflatable chamber formed of a flexible sheet material.

3. A leg and foot rest according to claim 1, including means in the main body portion for defining the overall shape of the body portion when the body portion is inflated.

4. A leg and foot rest according to claim 3, wherein the shape defining means includes one or more interior walls the perimeters of which correspond to perimeters of said side walls.

5. A leg and foot rest according to claim 4, wherein the interior walls define contiguous chambers having substantially identical outer peripheries.

6. A leg and foot rest according to claim 1, wherein the adjustment means is constructed and arranged to set a downward slope of the first surface along the major rest surface at an angle of about 35 degrees with respect to the floor.

7. A leg and foot rest according to claim 1, wherein the adjustment means is constructed and arranged to set an upward slope of the second surface along the major rest surface at an angle of about 55 degrees with respect to the floor.

8. A leg and foot rest according to claim 1, wherein the main body portion is of such a width as to enable a forward portion of the leg and foot rest to slide between rear leg supports of a passenger seat in front of the person.

* * * * *